US007121115B2

(12) United States Patent
Lemaire et al.

(10) Patent No.: US 7,121,115 B2
(45) Date of Patent: Oct. 17, 2006

(54) SOUR NATURAL GAS TREATING METHOD

(75) Inventors: Eric Lemaire, Lyons (FR); Fabrice Lecomte, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 10/726,506

(22) Filed: Dec. 4, 2003

(65) Prior Publication Data

US 2004/0107728 A1 Jun. 10, 2004

(30) Foreign Application Priority Data

Dec. 4, 2002 (FR) ..... 02 15314

(51) Int. Cl.
*F25J 3/00* (2006.01)
*B01D 47/00* (2006.01)
*B01D 53/14* (2006.01)

(52) U.S. Cl. ..... 62/625; 62/630; 62/636; 95/193; 95/235

(58) Field of Classification Search ..... 62/618, 62/620, 622, 625, 630, 636; 95/149, 172, 95/173, 174, 181, 193, 235
See application file for complete search history.

(56) References Cited

U.S. PATENT DOCUMENTS 4,097,250 A * 6/1978 Pagani et al. ..... 95/174
4,710,210 A * 12/1987 Gazzi et al. ..... 62/632
4,889,700 A * 12/1989 Elgue et al. ..... 423/220
5,735,936 A * 4/1998 Minkkinen et al. ..... 95/49
5,983,663 A 11/1999 Sterner
6,001,153 A * 12/1999 Lebas et al. ..... 95/181
6,102,987 A * 8/2000 Gross et al. ..... 95/172
6,645,272 B1 * 11/2003 Lemaire et al. ..... 95/174
6,666,908 B1 * 12/2003 Cadours et al. ..... 95/166
6,735,979 B1 * 5/2004 Lecomte et al. ..... 62/611
2002/0059865 A1 * 5/2002 Lemaire et al. ..... 95/174
2002/0062735 A1 * 5/2002 Lecomte et al. ..... 95/172
2002/0104438 A1 * 8/2002 Cadours et al. ..... 95/235

FOREIGN PATENT DOCUMENTS

FR 2342776 A 9/1977
FR 2808460 A 11/2001
FR 2814378 A 3/2002

* cited by examiner

*Primary Examiner*—William C. Doerrler
(74) *Attorney, Agent, or Firm*—Antonelli, Terry, Stout and Kraus, LLP.

(57) ABSTRACT

The invention relates to a method for treating a natural gas, saturated or not with water, containing essentially hydrocarbons, a substantial amount of hydrogen sulfide and possibly carbon dioxide. The method of the invention comprises a condensation stage intended to condense a major part of the water, a distillation stage wherein a gaseous effluent depleted in hydrogen sulfide and substantially free of water is recovered, and a contacting stage wherein the gaseous effluent from the previous stage is contacted with a solvent so as to obtain a treated gas substantially free of hydrogen sulfide and possibly of carbon dioxide.

12 Claims, 4 Drawing Sheets

SOUR NATURAL GAS TREATING METHOD

FIELD OF THE INVENTION

The invention relates to a method for treating a water-saturated natural gas containing a substantial amount of hydrogen sulfide, and possibly carbon dioxide and other sulfur compounds.

Treatment of natural gases generally requires a method with three successive stages. The first stage generally consists in reducing the proportion of sour gases such as hydrogen sulfide and carbon dioxide. This first stage, also known as deacidizing stage, is often followed by a water removal stage or dehydration, and by a consecutive stage of heavy hydrocarbon recovery.

BACKGROUND OF THE INVENTION

French patent FR-2,814,378 describes a natural gas pretreating method allowing to obtain, at a low cost, a methane-rich and hydrogen sulfide-depleted gas substantially free of all the water that said natural gas initially contained. A hydrocarbon-depleted aqueous liquid containing a large part of the hydrogen sulfide is obtained in parallel and generally injected into an underground reservoir, an oil production well for example. Thus, the method described in this French patent allows, within a single stage, to remove or to significantly reduce the water initially contained in the natural gas while reducing the sour constituent contents. The method described in this patent also allows to obtain a liquid phase containing mainly hydrogen sulfide, which can be readily pressurized and injected into the well. However, the method of French patent FR-2,814,378 does not allow to reduce the hydrogen sulfide and carbon dioxide content of the gas thus treated to an acceptable level as regards commercial requirements. It is therefore often necessary to reduce this sour gas content by post-treating. The methods generally used for these post-treatments are chemical absorption methods using, for example, solvents containing amines, at high temperatures or temperatures close to the ambient temperature. These post-treating methods allow deacidizing of the natural gas the chemical solvent absorbs the sour constituents by chemical reaction. However, they have the drawback of charging the deacidized gas with water because of the use of the chemical solvent in aqueous solution. Thus, the use of a chemical solvent requires a third treatment for removing the water contained in the deacidized gas in order to prevent hydrate formation. This third water removal treatment is often complicated and expensive in the prior art.

One of the objects of the invention is to overcome the problem of removal of almost all of the water initially contained in the natural gas and of reduction, to a commercially acceptable level, of the hydrogen sulfide content, and possibly the carbon dioxide content, of the treated gas while avoiding the drawbacks of the prior art.

SUMMARY OF THE INVENTION

A natural gas treating method has thus been found, wherein the water is first removed at the beginning of the treatment, then the hydrogen sulfide content and possibly the carbon dioxide and/or sulfur compounds contents are reduced to acceptable levels by contacting with a physical solvent.

The present invention thus relates to a method for treating a natural gas containing hydrocarbons, hydrogen sulfide, water and possibly carbon dioxide, wherein the following stages are carried out:

a) cooling the natural gas so as to condense the water and to recover a gaseous effluent, b) distilling the gaseous effluent obtained in stage a) so as to obtain a liquid phase and a gas phase, and cooling said gas phase so as to obtain a condensate and a gaseous effluent depleted in hydrogen sulfide and in water, and c) contacting at least part of the gaseous effluent obtained in stage b) with a first physical solvent so as to obtain a liquid effluent and a treated gas depleted in hydrogen sulfide, and possibly in carbon dioxide.

The natural gas intended to be treated by means of the method according to the invention is saturated or not with water. This natural gas is generally at the pressure and at the temperature of the production well or of any process used upstream.

The hydrocarbons in the natural gas can be such that at least 95% by weight of their compounds have one to seven carbon atoms. Generally, the hydrocarbons essentially contain compounds having one to two carbon atoms.

The natural gas intended to be treated contains a substantial amount of hydrogen sulfide. A substantial amount generally means between 5 and 50% by mole, preferably between 20 and 45% by mole, in particular between 30 and 40% by mole, for example 35%by mole.

The natural gas possibly contains carbon dioxide. The proportion of carbon dioxide can range from 0 to 40% by mole, preferably from 10 to 20% by mole. A natural gas can in particular contain 50 to 70% by mole of methane, 5 to 15% by mole of ethane, 0 to 5% by mole of propane, 5 to 50% by mole of hydrogen sulfide and 0 to 30% by mole of carbon dioxide. By way of example, the natural gas to be treated can contain 56% by mole of methane, 0.5% by mole of ethane, 0.2% by mole of propane, 0.03% by mole of butane, 0.25% by mole of water, 10.6% by mole of carbon dioxide, 31.5% by mole of hydrogen sulfide and various other compounds as traces.

During stage a) of the method according to the invention, the natural gas is cooled so as to condense a major part of the water. The zone in which the natural gas is cooled can be maintained at a temperature ranging from 0° C. to 50° C., preferably from 20° C. to 40° C.

After stage a), the condensed liquid containing the major part of the water can be injected into a production well.

Stage b) of the method according to the invention essentially consists in a distillation with control of the thermodynamic conditions according to the nature of the gas to be treated, notably its water content. This control allows progressive removal of the water contained in the gas to be treated while preventing or limiting hydrate formation.

The distillation of stage b) can be carried out at a temperature ranging between −30° C. and 100° C., preferably between 0° C. and 80° C. and at a pressure above 1 MPa abs., preferably between 4 and 10 MPa abs.

Distillation can be carried out in a distillation column or in at least two drums, each drum being under thermodynamic conditions (pressure and temperature) corresponding to a theoretical stage of a distillation column. Document FR-2,826,371 provides distillation in two drums. A distillation column used in stage b) can be selected so as to progressively reduce the water content, from the bottom to the top of the column, in order to recover at the top of said column a gaseous effluent substantially free of water. The gaseous effluent thus recovered advantageously has a water content that is lower than the hydrate formation limit at the lowest temperature of the next stages of the method according to the invention.

A distillation column used in stage b) can be made of any means known to the man skilled in the art. It can comprise a certain number of theoretical stages in order to remove the water at the top of the column and to maintain a temperature gradient between the bottom and the top of the column. Preferably, the column of stage b) comprises 2 to 10, for example 5 theoretical stages. The column can contain either conventional distillation trays, or a packing, stacked or not.

The gaseous effluent of stage a), which is generally water-saturated, can feed the distillation column of stage b) at a sufficiently low level of said column, i.e. at a point where the temperature is high enough to prevent or limit hydrate formation.

The distillation column used in stage b) can be advantageously equipped with a reboiler, which allows to maintain a sufficiently high temperature at the bottom of said column in order to prevent or limit hydrate formation. The presence of this reboiler also allows to minimize and to control hydrocarbon losses.

A liquid containing essentially water, hydrogen sulfide and carbon dioxide can be recovered during distillation stage b), for example at the bottom of the distillation column. This liquid can then be injected into a production well. Possibly, the calories of this liquid can be used to heat the gaseous effluent obtained in stage a), before distillation of said effluent in stage b). The gas obtained by distillation during stage b) can be cooled by means of at least two successive refrigerations. The condensate obtained by cooling the gas can be recycled to the top of the distillation column.

The gaseous effluent obtained in stage b) can be at a temperature ranging from −100° C. to 30° C., preferably from −40° C. to 0° C. and at a pressure above 1 MPa abs. preferably between 4 and 10 MPa abs.

During contacting stage c) of the method according to the invention, at least part of the substantially water-free gaseous effluent obtained in stage b) is contacted with a physical solvent.

This physical solvent can be an alcohol, methanol for example.

Preferably, the solvent used in stage c) is an aqueous solvent having a water content below 50% by weight, preferably below 40% by weight, in particular below 30% by weight.

This solvent may have been previously cooled by any means such as expansion means and/or thermal exchange means.

Contacting can be carried out by any, means such as a device comprising an absorption column. This contacting stage can be carried out under countercurrent conditions in one or more contact zones arranged in one or more enclosures. The contact zone can consist of trays or of a packing, stacked or not, preferably a stacked packing. Contacting can be performed at a temperature below 20° C., preferably below 0° C., for example at a temperature ranging between −50° C. and 20° C., preferably between −40° C. and 0° C., and at a pressure ranging from 0.5 to 10 MPa abs., preferably from 4 to 9 MPa abs.

During stage c), a liquid effluent essentially containing solvent, hydrogen sulfide, carbon dioxide and co-adsorbed hydrocarbons is recovered.

A treated gas substantially free of hydrogen sulfide and possibly of carbon dioxide is also recovered. This treated gas can contain less than 0.1% by mole, preferably less than 10 ppm by mole, for example less than 5 ppm by mole of hydrogen sulfide, and less than 5% by mole, preferably less than 3% by mole, for example less than 2% by mole of carbon dioxide.

According to a particular embodiment of the invention, the treating method can be associated with a method for upgrading a gaseous fuel possibly containing hydrogen sulfide and carbon dioxide. Thus, according to this particular embodiment, the method of the invention also comprises the following stages:

d) expanding the liquid effluent obtained in stage c) so as to obtain a hydrocarbon-depleted liquid effluent and a gaseous effluent containing hydrocarbons, and e) contacting the gaseous effluent obtained in stage d) with a second physical solvent so as to obtain a liquid effluent containing hydrogen sulfide and a fuel containing hydrocarbons.

Stage d) essentially consists in an expansion allowing to obtain a liquid effluent and a gaseous effluent from the liquid effluent of stage c).

Expansion can be carried out by means of a pressure variation from 0.5 to 10 MPa, preferably from 1 to 7 MPa. This expansion can be performed by any means known to the man skilled in the art, such as a valve or an expander, as shown in the figures. After this expansion, a liquid effluent which can contain essentially solvent, possibly water, hydrogen sulfide and carbon dioxide is recovered. The liquid effluent obtained in stage d) can be recycled to stage c) as first physical solvent. Expansion of the solvent can be carried out at least at two different pressure levels. At each pressure level, the gases released upon expansion are discharged.

A gaseous effluent essentially containing hydrocarbons is also recovered. The hydrocarbons content of the gaseous effluent can be above 50% by mole, preferably above 70% by mole.

Stage e) then allows to recover a gaseous effluent that can be used as fuel.

During this stage e), the gaseous effluent from stage d) is contacted with solvent. This solvent can be identical to or different from the solvent used in stage c). The solvent is preferably identical to the solvent used in stage c).

This solvent may have been previously cooled by any means such as expansion means and/or thermal exchange means.

Contacting can be carried out using any means such as one or more absorption columns. This contacting stage can be carried out under countercurrent conditions in one or more enclosures.

The contact column can consist of trays or of a packing, stacked or not, preferably a packed stacking. This contact column can be maintained at a temperature ranging between −40° C. and 20° C., preferably between −30° C. and −10° C., and at a pressure ranging from 0.5 to 5 MPa abs., preferably from 1 to 2 MPa abs.

After this contacting stage e), a fuel essentially containing hydrocarbons is recovered. The hydrocarbon content of the fuel can be above 50% by mole, preferably above 75% by mole. The fuel obtained is partly freed from hydrogen sulfide and carbon dioxide. The fuel advantageously contains less than 3% by mole, preferably less than 1% by mole, for example less than 100 ppm by mole of hydrogen sulfide.

According to another particular embodiment of the invention, the treating method can be associated with a solvent regeneration method. Thus, according to this particular embodiment, the method of the invention also comprises the following stage:

f) distilling in a distillation column at least one of the liquid effluents obtained in stages c), d) and e) so as to obtain a regenerated solvent at the bottom of said column and a gas at the top of the column.

The following stage can be carried out before stage f):

g) heating at least one of the liquid effluents obtained in stages c), d) and e) so as to obtain a mixed effluent containing a liquid phase and a gas phase.

When the treating method is associated with a method for upgrading a gaseous fuel possibly containing hydrogen sulfide, stage g) generally consists in heating the liquid effluents from stages d) and/or e).

In the absence of such a gaseous fuel upgrading method, the heating procedure of stage d) is generally applied to the liquid effluent obtained in stage c). In this case, an intermediate stage wherein the liquid effluent obtained in stage c) is expanded is preferably provided.

According to an advantageous embodiment, the gas phase obtained in stage g) can be fed into the top of the distillation column of stage f) separately from the liquid phase obtained in stage g).

Heating of the liquid effluents from stages d), e) and/or c) is carried out at a temperature ranging from 20° C. to 100° C., preferably from 70° C. to 90° C., in order to obtain a mixed effluent containing a liquid phase and a gas phase. The gas phase thus obtained essentially comprises all of the hydrogen sulfide and the carbon dioxide of said liquid effluents and/or of said condensate.

Distillation stage f) then allows to recover a solvent that is regenerated. Stage f) essentially consists in distillation with control of the thermodynamic conditions, such as for example the pressure and the temperature.

The distillation column of stage f) can be maintained at a temperature ranging between −30° C. and 200° C., preferably between −15° C. and 140° C., and at a pressure above 0.1 MPa abs., preferably ranging from 0.2 to 1 MPa abs.

During stage f), the gas obtained at the top of the column can be cooled in order to obtain a sour gas, as well as a condensate containing essentially solvent. The condensate can be recycled, at least partly, to the top of the column. The gas obtained at the top of the distillation column in stage f) can also be cooled by at least two successive refrigerations, after which the condensates are recycled, at least partly, to the top of the column.

The sour gas is almost solvent-free and it essentially contains hydrogen sulfide and carbon dioxide. The zone in which this sour gas is recovered can be maintained at a temperature ranging from −40° C. to 10° C., preferably from −30° C. to −10° C., and at a pressure above 0.1 MPa abs., preferably ranging from 0.2 to 0.6 MPa abs.

The distillation column of stage f) can be advantageously equipped with a reboiler, which allows to maintain a sufficiently high temperature at the bottom of said column in order to reduce the proportion of hydrogen sulfide at the bottom of said column.

A regenerated solvent essentially containing solvent is thus recovered at the bottom of the column. The solvent thus regenerated can be advantageously used as a heat carrier for heating one of the liquid effluents obtained in stages c), d) and/or e).

According to a preferred embodiment of the invention, the treated gas obtained after stage c) is used in the method as coolant. In particular, the treated gas can be advantageously used to cool the gas obtained in stage b) and/or stage f). This treated gas can also be used to cool the solvent prior to stages c) and/or e). Thus, the energy supplies for implementing the method according to the invention can be optimized.

The natural gas treating method requires no dehydration treatment after the deacidizing treatment.

Another advantage of the invention is to reduce the carbon dioxide and, sulfur compounds content. Apart from hydrogen sulfide, sulfur compounds are meant to be compounds containing sulfur such as, for example, carbon sulfide, carbon oxysulfide and mercaptans.

Another advantage of the invention is that it provides a simple, economical method with optimized energy supplies. It generally applies to a treated gas having a water content below 50, preferably below 10 and more preferably below 5 ppm by mole, and a hydrogen sulfide content below 1000, preferably below 100 and more preferably below 10 ppm by mole. The pretreated gas can possibly also have a carbon dioxide content below 10, preferably below 5 and more preferably below 2% by mole.

Implementation of a dehydration stage according to the invention, using no physical solvent, has the advantage of reducing hydrocarbon losses. In fact, contacting a natural gas with a physical solvent generally causes co-absorption of the hydrocarbons by the solvent. It therefore applies to a treated gas containing at least 70, preferably at least 80 and more preferably at least 95% by mole of hydrocarbons in relation to the amount of hydrocarbons initially contained in the natural gas.

The method according to the invention allows to prevent hydrate formation by removal of the water prior to deacidizing and heavy hydrocarbon recovery.

BRIEF DESCRIPTION OF THE FIGURES

Other features and advantages of the invention will be clear from reading the description hereafter, given by way of non limitative example, with reference to the accompanying figures. A material balance is given by way of example to complete this illustration.

DETAILED DESCRIPTION

Figure 1:
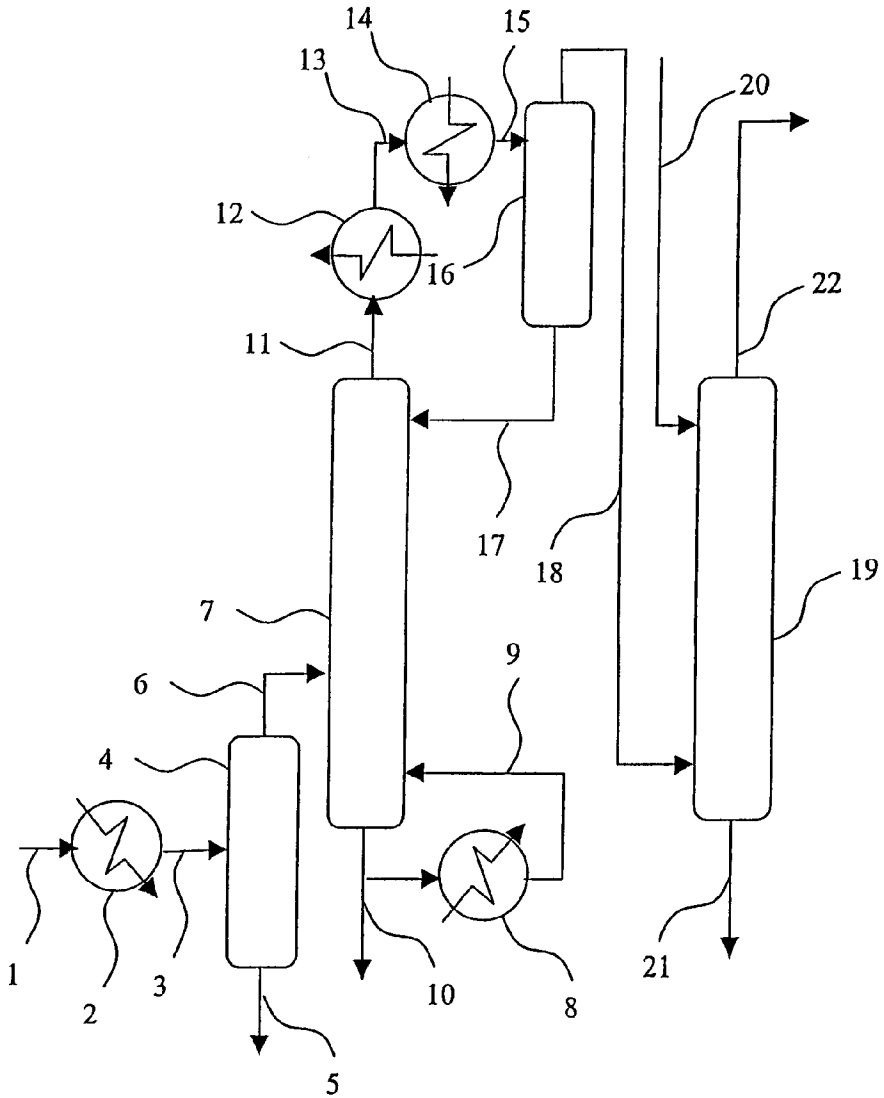
FIG. 1 illustrates, by way of example, a device for implementing the method according to the invention.

FIG. 1 shows a device for implementing the method according to the invention. This method is used for treating a very sour natural gas, water-saturated and containing approximately 32% by mole of hydrogen sulfide, 11% by mole of carbon dioxide and 57% by mole of methane. The natural gas is fed through a line (1) into an exchanger (2) where it is cooled to 30° C. so as to condense a major part of the water. At the exchanger outlet, the gas thus cooled is transferred, by means of a line (3), into a separator (4). A condensed liquid containing the major part of the water is discharged from the separator through a line (5) and a gaseous effluent whose water content has been reduced from approximately 2700 to 1100 ppm by mole is recovered through a line (6).

This gaseous effluent is introduced at the level of a bottom tray of a distillation column (7) maintained at a pressure of 8.96 MPa. A reboiler (8) and a line (9) are used to maintain a temperature of 70° C. at the bottom of column (7). A liquid essentially containing hydrogen sulfide is recovered at the bottom of the distillation column through a line (10). At the top of the column, the gas is discharged through a line (11)

in order to be cooled in a first exchanger (12) by means of a coolant which can advantageously be the treated gas. This fluid is then transferred by means of a line (13) into a second exchanger (14) in order to be cooled to a temperature of approximately −30° C., by means of a coolant such as propane. The fluid thus cooled is transferred through a line (15) into a separator (16) in which a temperature of −30° C. and a pressure of 7.63 MPa prevail. A condensate rich in hydrogen sulfide and carbon dioxide, but also containing methane and various hydrocarbons, is obtained at the bottom of the separator. This condensate is then recycled to the top of the column by means of a line (17). A gaseous effluent substantially free of water is collected at the top of the separator.

The gaseous effluent thus recovered through line (18) contains the major part of the methane initially contained in the natural gas. In fact, the methane loss is only 2% by mole in relation to the amount present in the feed flowing in through line (1). This gaseous effluent is also freed of 72% by mole of the hydrogen sulfide initially present in the feed. The water content of this gaseous effluent being extremely reduced, hydrate formation is thus unlikely during the next stages of the treating method.

The gaseous effluent substantially free of water collected at the top of separator (16) is then transferred, by means of a line (18), to the base of a contact column (19) in which said effluent is contacted with a methanol-based aqueous solvent having a water content of approximately 25% by mole, a methanol content of approximately 75% by mole and traces of hydrogen sulfide. This solvent has first been cooled to a temperature of approximately −25° C. The contact column is a countercurrent column in which the solvent is fed at the top, through a line (20), and a liquid effluent is discharged at the bottom of the column through a line (21). The column is maintained at a pressure of 7 MPa. A treated gas containing only 10 ppm by mole of hydrogen sulfide and 2% by mole of carbon dioxide is thus recovered at the top of the column by means of a line (22).

Table 1 hereafter shows, for the method implementation example shown in FIG. 1, a material balance obtained in various stages of the method.

TABLE 1

| | Line No. | | | | | |
|---|---|---|---|---|---|---|
| | (1) | (3) | (6) | (18) | (21) | (22) |
| Temperature (° C.) | 50.0 | 30.0 | 30.0 | −30.0 | −15.8 | −20.3 |
| Pressure (MPa) | 9.0 | 8.97 | 8.96 | 7.63 | 7.0 | 7.0 |
| Molar mass | 24.86 | 24.86 | 24.87 | 21.58 | 29.27 | 16.72 |
| | Molar flow rates (kmol/h) | | | | | |
| H2O | 67.2 | 67.2 | 27.3 | 0.1 | 6999.9 | 0.1 |
| N2 | 10.0 | 10.0 | 10.0 | 9.9 | 0.3 | 9.6 |
| CO2 | 2659.4 | 2659.4 | 2659.2 | 2164.6 | 1896.1 | 268.6 |
| H2S | 7875.3 | 7875.3 | 7875.3 | 2190.6 | 2190.8 | 0.1 |
| Methane | 14184.0 | 14184.0 | 14184.0 | 13954.8 | 1369.3 | 12585.5 |
| Ethane | 114.5 | 114.5 | 114.5 | 94.7 | 27.1 | 67.6 |
| Propane | 44.8 | 44.8 | 44.8 | 18.8 | 12.7 | 6.1 |
| Butane | 7.5 | 7.5 | 7.5 | 0.4 | 0.3 | 0.0 |
| Pentane | 5.0 | 5.0 | 5.0 | 0.0 | 0.0 | 0.0 |
| MeOH | | | | | 20995.6 | 4.1 |
| TOTAL (kmol/h) | 24967.6 | 24967.6 | 24926.6 | 18434.0 | 33492.1 | 12941.8 |

Figure 2:
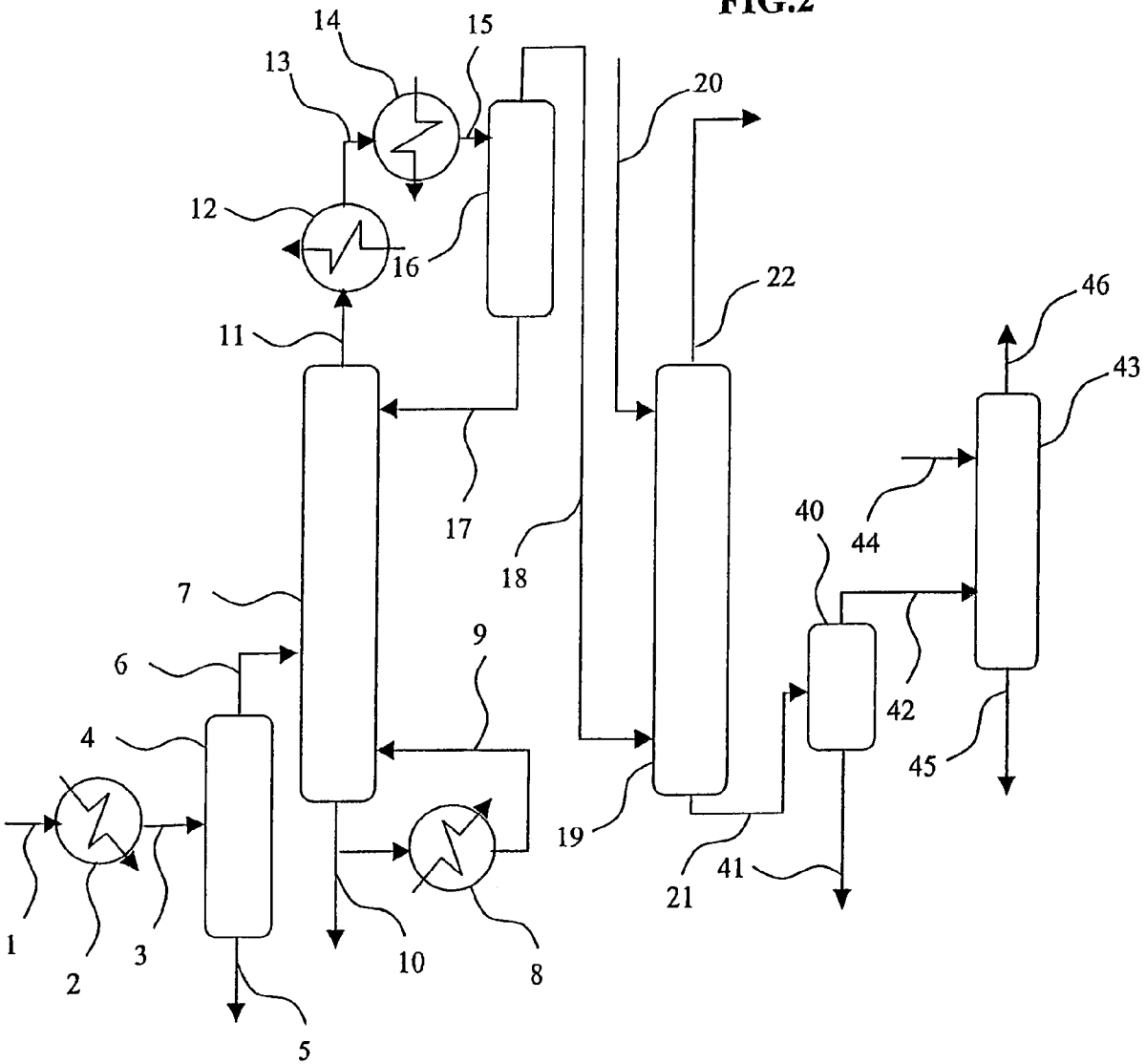
FIG. 2 illustrates a particular embodiment of the invention allowing to recover a gaseous fuel.

FIG. 2 shows a device for implementing the method according to the invention also allowing recovery of a gaseous fuel rich in carbon dioxide. The elements already shown in FIG. 1 appear in FIG. 2 with the same reference numbers from 1 to 22.

The device shown thus allows to recover a fuel from the liquid effluent obtained at the bottom of contact column (19). This liquid is channelled by means of a line (21).

This liquid is then transferred into a separator (40) where it undergoes expansion allowing to obtain a liquid effluent and a gaseous effluent.

Expansion is carried out by means of a pressure variation of 5.9 MPa. After this expansion, a liquid effluent discharged through line (41) and a gaseous effluent essentially containing hydrocarbons are recovered.

The gaseous effluent is then transferred, by means of a line (42), to the base of a contact column (43) where said effluent is contacted with an aqueous solvent. In this example, the solvent used in column (43) is the same as the solvent used in column (19), i.e. a methanol-based aqueous solvent having a water content of approximately 25% by mole, a methanol content of approximately 75% by mole, and traces of hydrogen sulfide. Similarly, this solvent has also first been cooled to a temperature of approximately −25° C. Contact column (43) is a countercurrent column in which the solvent is delivered at the top, through a line (44), and a liquid effluent is discharged at the bottom of the column through a line (45). The column is maintained at a pressure of 1.1 MPa and at a temperature of approximately −25° C. A fuel containing approximately 70% by mole of methane and 25% by mole of carbon dioxide is thus recovered at the top of the column, through a line (46), the goal being to recover hydrocarbons that can be upgraded in order to be used as fuel.

Figure 3:
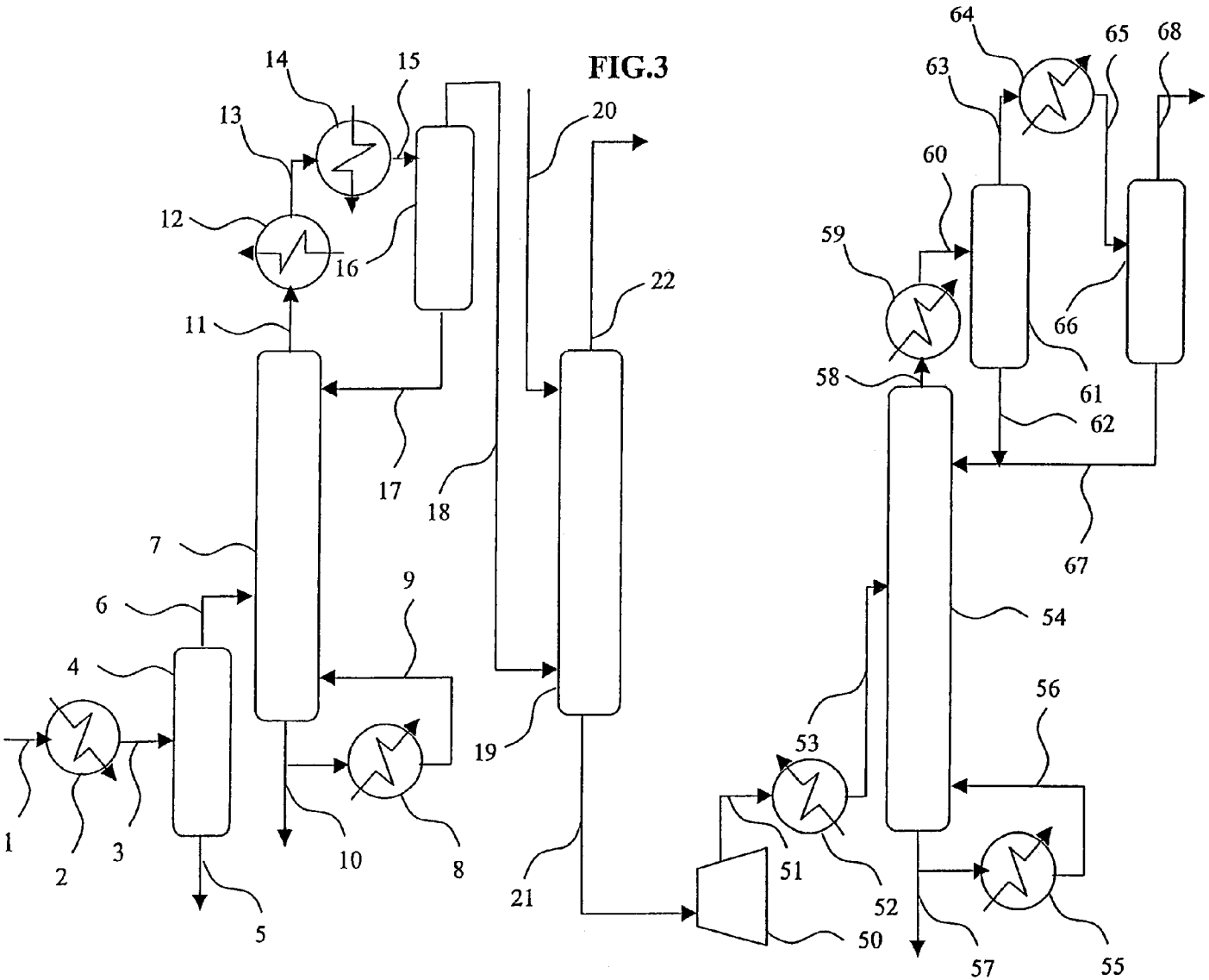
FIG. 3 illustrates another particular embodiment of the invention allowing solvent regeneration.

FIG. 3 shows a device for implementing the method according to the invention allowing solvent regeneration. The elements shown in FIG. 1 also appear here with the same reference numbers from 1 to 22. The device shown thus allows regeneration of the solvent from the liquid effluent obtained at the bottom of column (19). This liquid is channelled by means of line (21).

This liquid is then first expanded in an expander (50) by means of a pressure variation of 5.4 MPa. The effluent obtained is transferred, through a line (51), into an exchanger (52) where it is heated to a temperature of approximately 101° C. so as to obtain a mixed effluent comprising a liquid phase and a gas phase. The gas phase thus obtained essentially contains all of the hydrogen sulfide and the carbon dioxide of the liquid effluent circulating in line (21).

This gas phase is fed, through a line (53), into a distillation column (54) maintained at a pressure of 1 MPa. At the bottom of column (54), a reboiler (55) and a line (56) are used to maintain a temperature of approximately 141° C. A regenerated solvent essentially containing methanol and water is collected at the bottom of the distillation column by means of a line (57). A gas essentially containing sour gases, i.e. a gas containing essentially hydrogen sulfide and carbon dioxide, as well as methanol, is obtained at the top of the column. This gas, which is at a pressure of 1 MPa and at a temperature of 30° C., is discharged through a line (58) to be cooled in a first exchanger (59). The fluid thus cooled is transferred through a line (60) into a first separator (61) at the bottom of which a condensate is recycled to the top of column (54) through a line (62). A gaseous effluent is recovered at the top of the first separator and transferred by means of a line (63) into a second exchanger (64) where it is cooled to a temperature of approximately −10° C., by means of a coolant which can advantageously be the treated gas. The fluid thus cooled is transferred through a line (65) into a second separator (66). A condensate essentially containing solvent and water is obtained at the bottom of the second separator and recycled to the top of the column through a line (67). A sour gas, which can optionally be compressed and reinjected into a production well, is recovered at the top of the separator through a line (68).

Figure 4:
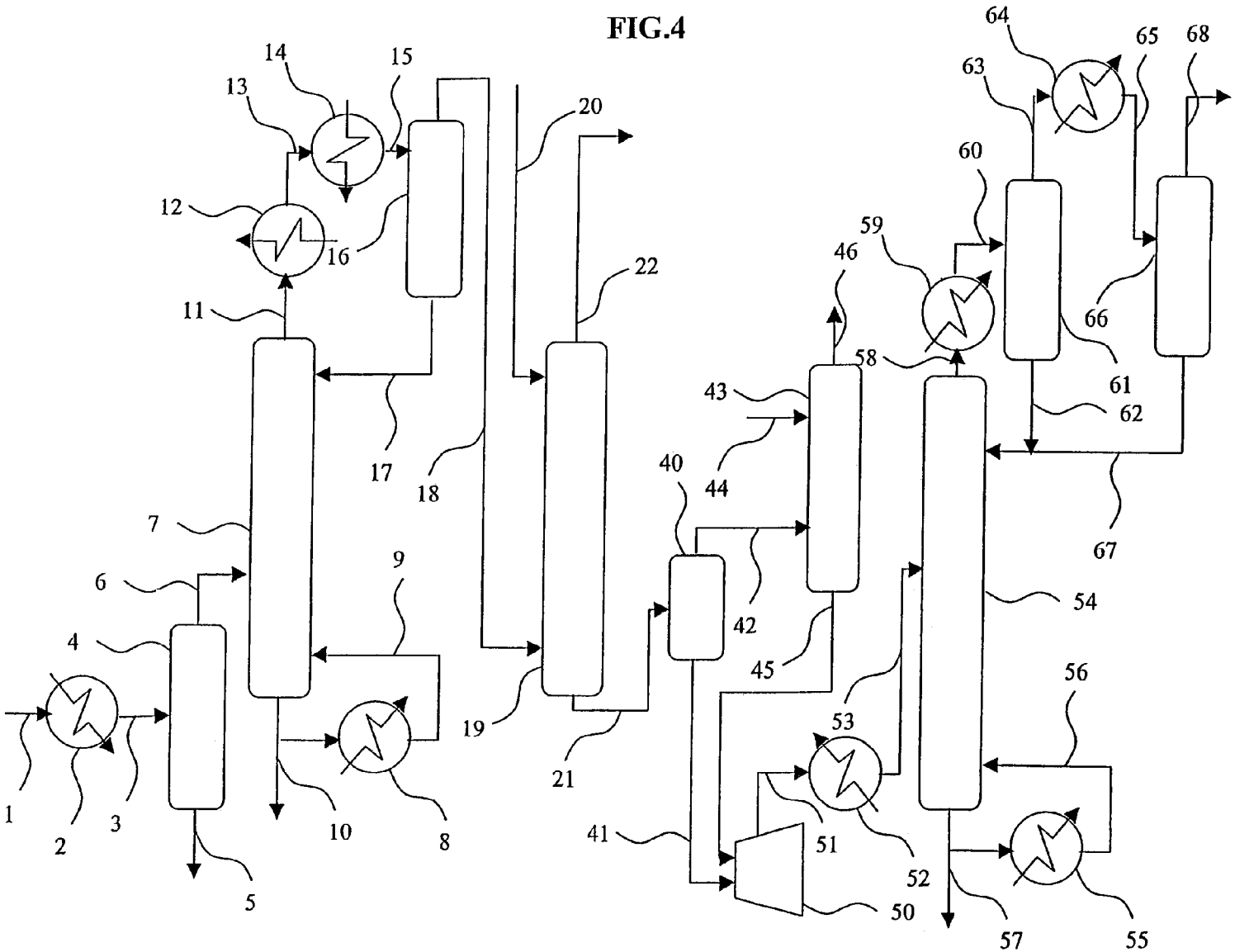
FIG. 4 illustrates yet another particular embodiment of the invention combining recovery of a gaseous fuel and regeneration of the solvent.

FIG. 4 shows a device for implementing the method according to the invention combining recovery of a gaseous fuel and solvent regeneration. The same elements as shown in FIGS. 1, 2 and 3 appear here with the same reference numbers from 1 to 22, 40 to 46 and 50 to 68. The method shown thus allows recovery of a fuel from the liquid effluent obtained at the bottom of contact column (19). This liquid is channelled by means of line (21). The method shown also allows regeneration of the solvent from the liquid effluent obtained at the bottom of separator (40) and from the liquid effluent discharged at the bottom of contact column (43). The two liquids are channelled by means of lines (41) and (45).

Table 2 hereunder shows, for the implementation example illustrated in FIG. 4, a material balance obtained in the stages of the method relative to upgrading of a fuel and solvent regeneration. The material balance relative to the stages common to FIG. 4 and FIG. 1 is identical to the balance shown in Table 1.

TABLE 2

| | Line No. | | | | |
|---|---|---|---|---|---|
| | (46) | (41) | (53) | (68) | (57) |
| Temperature (° C.) | −13.5 | −20.7 | 101.2 | −10.0 | 141.3 |
| Pressure (MPa) | 1.1 | 1.1 | 1.0 | 0.95 | 1.0 |
| Molar mass | 23.88 | 29.46 | 29.59 | 36.91 | 28.71 |
| | Molar flow rates (kmol/h) | | | | |
| H2O | 0.1 | 6999.929 | 7599.9 | 0.0 | 7599.9 |
| N2 | 0.3 | 0.0 | 0.0 | 0.0 | 0.0 |
| CO2 | 422.0 | 1316.7 | 1475.4 | 1475.4 | 0.0 |
| H2S | 44.4 | 1974.1 | 2146.4 | 2146.2 | 0.2 |
| Methane | 1161.4 | 181.0 | 208.3 | 208.3 | 0.0 |
| Ethane | 14.0 | 11.5 | 13.1 | 13.1 | 0.0 |
| Propane | 2.1 | 9.5 | 10.6 | 10.6 | 0.0 |
| Butane | 0.0 | 0.3 | 0.3 | 0.3 | 0.0 |
| Pentane | 0.0 | 0.0 | 0.0 | 0.0 | 0.0 |
| MeOH | 2.5 | 20998.3 | 24397.3 | 6.6 | 24390.7 |
| TOTAL (kmol/h) | 1646.8 | 31491.2 | 35851.5 | 3860.7 | 31990.8 |

The invention claimed is:

1. A method for treating a natural gas containing hydrocarbons, between 20 and 45% by mole hydrogen sulfide, and water, wherein the following stages are carried out:

a) cooling the natural gas so as to condense water and to recover a gaseous effluent, b) distilling the gaseous effluent obtained in stage a) so as to obtain a liquid phase and a gas phase, and cooling said gas phase to a temperature ranging from −40° C. to 0° C. so as to obtain a condensate and a gaseous effluent depleted in hydrogen sulfide and in water, c) contacting at least part of the gaseous effluent obtained in stage b) with a first physical solvent at a temperature ranging between −40° C. and 0° C. so as to obtain a liquid effluent and a treated gas depleted in hydrogen sulfide, d) expanding the liquid effluent obtained in stage c) so as to obtain a hydrocarbon-depleted liquid effluent and a gaseous effluent containing hydrocarbons, and e) contacting the gaseous effluent obtained in stage d) with a second physical solvent so as to obtain a liquid effluent containing hydrogen sulfide and a fuel containing hydrocarbons.

2. A method as claimed in claim 1, wherein the gaseous effluent obtained in stage b) is maintained at a pressure above 1 MPa abs.

3. A method as claimed in claim 1, wherein the first physical solvent is an aqueous solvent having a water content below 50% by weight.

4. A method as claimed in claim 1, comprising the following stage:

f) distilling in a distillation column at least one of the liquid effluents obtained in stages c), d) and e) so as to obtain a regenerated solvent at the bottom of said column.

5. A method as claimed in claim 4, wherein the following stage is carried out before stage f):

g) heating at least one of the liquid effluents obtained in stages c), d) and e) so as to obtain a mixed effluent containing a liquid phase and a gas phase.

6. A method as claimed in claim 1, further comprising the following stage:

f) distilling in a distillation column at least the liquid effluent obtained in stage c) so as to obtain a regenerated solvent at the bottom of said column.

7. A method as claimed in claim 6, wherein the following stage is carried out before stage f):

g) heating at least the liquid effluent obtained in stage c) so a to obtain a mixed effluent containing a stage liquid phase and a gas phase.

8. A method as claimed in claim 1, wherein stage c) is carried out at a temperature ranging between −30 and −10° C.

9. A method as claimed in claim 8, wherein stage c) is carried out at a pressure ranging between 0.5 to 5 MPa abs.

10. A method as claimed in claim 8, wherein stage c) is carried out at a pressure ranging between 1 to 2 MPa abs.

11. A method as claimed in claim 1, wherein stage c) is carried out at a pressure ranging between 0.5 to 5 MPa abs.

12. A method as claimed in claim 1, wherein stage c) is carried out at a pressure ranging between 1 to 2 MPa abs.

* * * * *